US006771731B2

(12) United States Patent
Georgii

(10) Patent No.: US 6,771,731 B2
(45) Date of Patent: Aug. 3, 2004

(54) DEVICE FOR STORAGE OF HAZARDOUS MATERIAL

(75) Inventor: Hans Georgii, London (GB)

(73) Assignee: Oyster International N.V., Curacao (NL)

( * ) Notice: Subject to any disclaimer, the term of this patent is extended or adjusted under 35 U.S.C. 154(b) by 0 days.

(21) Appl. No.: 10/257,142

(22) PCT Filed: Apr. 11, 2001

(86) PCT No.: PCT/SE01/00810

§ 371 (c)(1),
(2), (4) Date: Oct. 9, 2002

(87) PCT Pub. No.: WO01/78083

PCT Pub. Date: Oct. 18, 2001

(65) Prior Publication Data

US 2003/0076917 A1 Apr. 24, 2003

(30) Foreign Application Priority Data

Apr. 11, 2000 (SE) ..... 0001327

(51) Int. Cl.[7] ..... G21C 19/06

(52) U.S. Cl. ..... 376/272; 376/347; 250/506.1; 250/507.1; 220/645; 220/646; 220/653; 220/654; 588/3; 588/16; 29/446; 29/452; 264/228; 264/229

(58) Field of Search ..... 376/272, 347; 250/506.1, 507.1; 220/645, 646, 653, 654; 588/16, 3; 29/446, 452; 264/228, 229

(56) References Cited

U.S. PATENT DOCUMENTS

| | | | | | |
|---|---|---|---|---|---|
| 3,579,931 | A | * | 5/1971 | Lang | 52/745.21 |
| 3,686,875 | A | * | 8/1972 | Morgan | 405/210 |
| 3,726,461 | A | | 4/1973 | Fukushima et al. | 228/5 |
| 3,801,444 | A | * | 4/1974 | Kraemer | 376/295 |
| 4,044,088 | A | * | 8/1977 | Hume | 264/130 |
| 4,175,005 | A | * | 11/1979 | Harstead | 376/293 |
| 4,185,440 | A | * | 1/1980 | Finsterwalder | 52/745.19 |
| 4,560,424 | A | * | 12/1985 | Augoyard | 148/526 |
| 4,799,828 | A | * | 1/1989 | Georgii | 405/195.1 |
| 4,806,771 | A | * | 2/1989 | Mallory | 250/506.1 |
| 5,134,830 | A | * | 8/1992 | Dykmans | 52/745.01 |
| 5,303,836 | A | * | 4/1994 | Childress | 220/1.5 |
| 5,327,469 | A | * | 7/1994 | Georgii | 376/272 |
| 5,408,793 | A | * | 4/1995 | Dykmans | 52/81.6 |
| 5,881,530 | A | * | 3/1999 | Dykmans | 52/745.2 |
| 5,950,557 | A | * | 9/1999 | Georgii | 114/257 |
| 6,008,428 | A | * | 12/1999 | Georgii | 588/16 |
| 6,372,157 | B1 | * | 4/2002 | Krill et al. | 252/478 |

FOREIGN PATENT DOCUMENTS

| | | | |
|---|---|---|---|
| CH | 1236800 A | * | 2/1984 |
| DE | 3321250 A1 | * | 12/1984 |
| DE | 35 15 871 | | 11/1986 |
| DE | 3515871 A | * | 11/1986 |

(List continued on next page.)

*Primary Examiner*—Michael J. Carone
*Assistant Examiner*—John Richardson
(74) *Attorney, Agent, or Firm*—Stites & Harbison PLLC; Douglas E. Jackson

(57) ABSTRACT

A device (10) for storage of hazardous material, especially heat-producing hazardous material, such as radioactive spent nuclear reactor fuel, comprises a substantially cylindrical reinforced concrete body (12) and has an axially elongate storage space (18) for the hazardous material. A prestressed reinforcement (17) having reinforcing members (28, 29) extending helically about the storage space (18) is provided in the concrete body (12) adjacent to the outer side thereof. Preferably, the reinforcing members (28, 29) are divided into two groups, one inside the other, the hand of the reinforcing members (28) of one of the groups being opposite to the hand of the reinforcing members (29) of the other group. Also preferably, the ends of the concrete body are provided with end covers (15, 16) in which the reinforcing members (28, 29) are anchored.

6 Claims, 7 Drawing Sheets

FOREIGN PATENT DOCUMENTS

| | | | |
|---|---|---|---|
| EP | 0 132 254 | | 1/1985 |
| FR | 2705824 | * | 5/1993 |
| GB | 2060565 | * | 9/1980 |
| JP | 2001-166083 | * | 6/2001 |
| JP | 2002-323593 | * | 8/2002 |
| WO | WO 96/21932 | | 1/1996 |
| WO | WO 00/33320 | * | 6/2000 |

* cited by examiner

DEVICE FOR STORAGE OF HAZARDOUS MATERIAL

This invention relates to a device for storage of hazardous material, especially heat-producing hazardous material, such as radioactive spent nuclear fuel. More particularly, the invention relates to a device having a substantially cylindrical reinforced concrete body with an axially elongate storage space for the hazardous material.

Devices of this kind can be used both for temporary and short-term storage, such as interim storage while awaiting reprocessing or other treatment in the case of spent nuclear fuel, and for long-term storage.

WO96/21932 and DE-A1-3515971 show examples of prior art embodiments of such devices.

In the embodiments which are known from these publications, and also in other prior art devices of the same general kind, the concrete body has a central storage space for accommodating the hazardous material. The concrete wall surrounding the storage space, the thickness of which is much larger than the width of the storage space, is reinforced in three dimensions.

In the embodiment shown in WO96/21932 the reinforcement comprises axial pre-stressed reinforcement cables or rods arranged in a ring between the storage space and the cylindrical outer surface of the concrete body, and a pre-stressed reinforcement wound about the outer surface. Naturally, the latter reinforcement is applied only after the concrete body is cast and hardened at least to some extent.

The concrete body of the embodiment shown in DE-A1-3515871 also has a central storage space for accommodating the hazardous material. However, in this embodiment the reinforcement is distributed over the entire cross-section of the wall of the concrete body and completely embedded in the concrete.

The device according to the present invention is characterised in that a pre-stressed reinforcement having reinforcing members which run helically about the storage space is provided in the concrete body adjacent the outer side thereof. Preferably, the reinforcing members are arranged in two groups, one within and adjacent the other, the hand of the reinforcing members of one group being opposite to the hand of the reinforcing members of the other group. The reinforcing members may be rods, cables or wires.

With this construction of the device, the concrete body has a very effective reinforcement that is also advantageous from a production point of view.

According to a feature of one embodiment of the invention the concrete body is provided with end covers, suitably of steel, in which the reinforcing members are anchored.

The end covers offer possibilities of a simple and effective connection of the reinforcing members to pre-stressing devices and anchoring devices and also of a desired distribution of the tensioning force over the end faces of the concrete body and of introduction of the lifting forces into the concrete body through the reinforcing members.

Moreover, the end covers can be used for anchoring lifting aids, such as lifting eyes or other devices for connecting lifting hooks, lifting yokes or the like to the storage device.

The invention will be described in greater detail below with reference to the accompanying diagrammatic drawings, which show an embodiment of the invention, given by way of example only.

Figure 1:
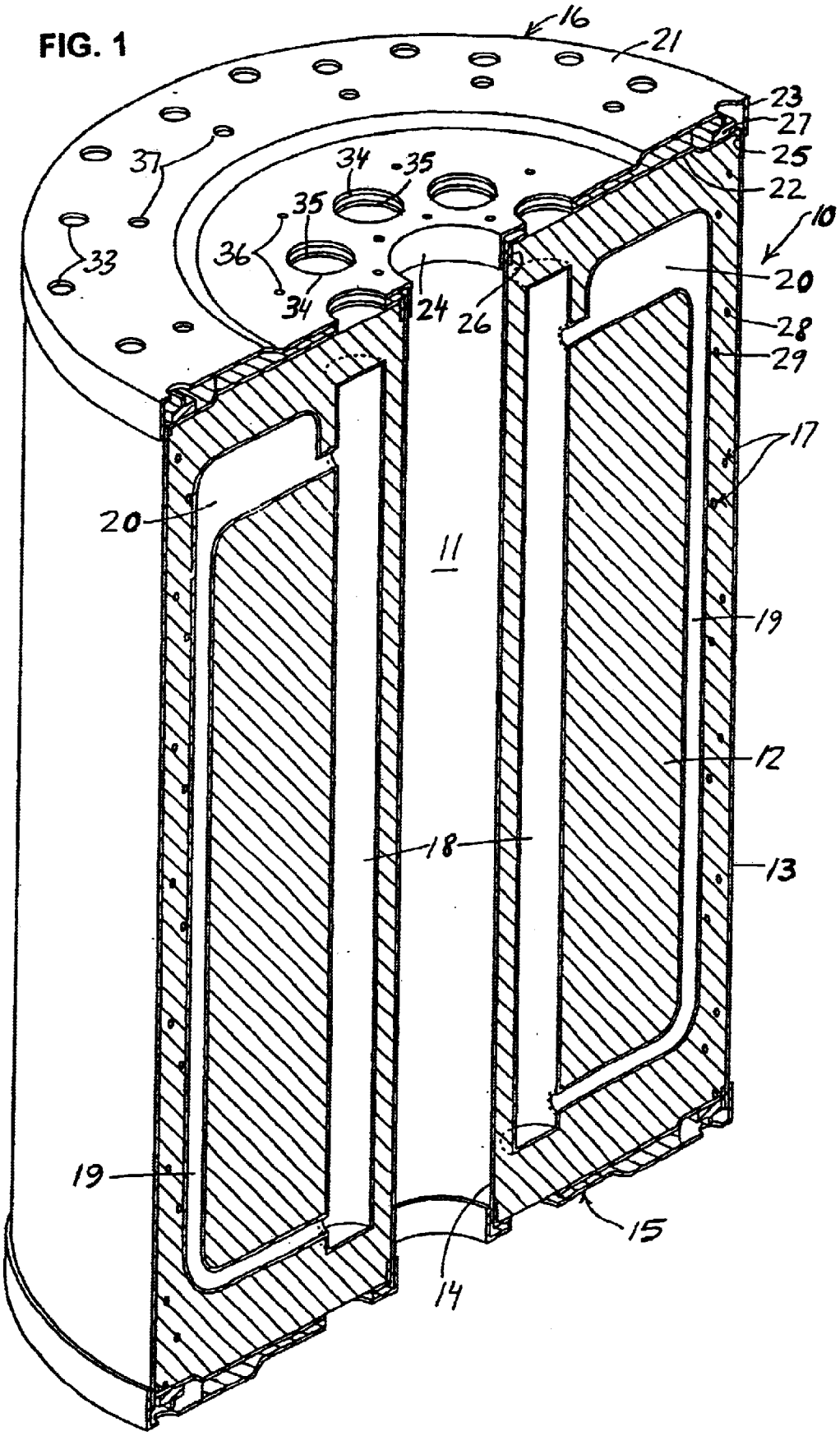
FIG. 1 is a sectional perspective view in axial diametral section of a storage device having a storage space formed by eight storage compartments, each for accommodating a nuclear fuel unit.
Figure 2:
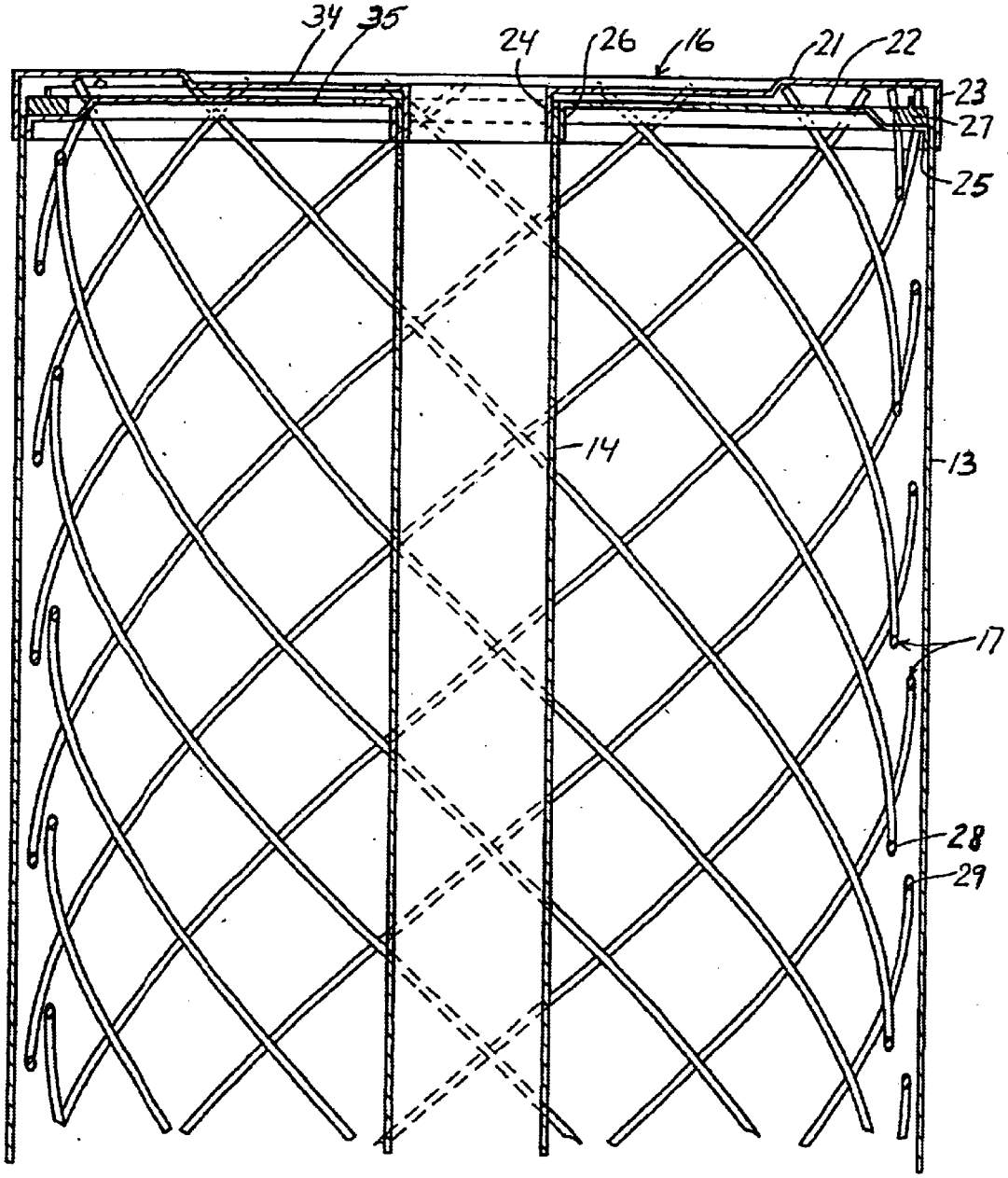
FIG. 2 is a view in diametral section of an end cover of the storage device, part of a reinforcement anchored in the end cover, and parts of elements serving as concrete formwork.
Figure 3:
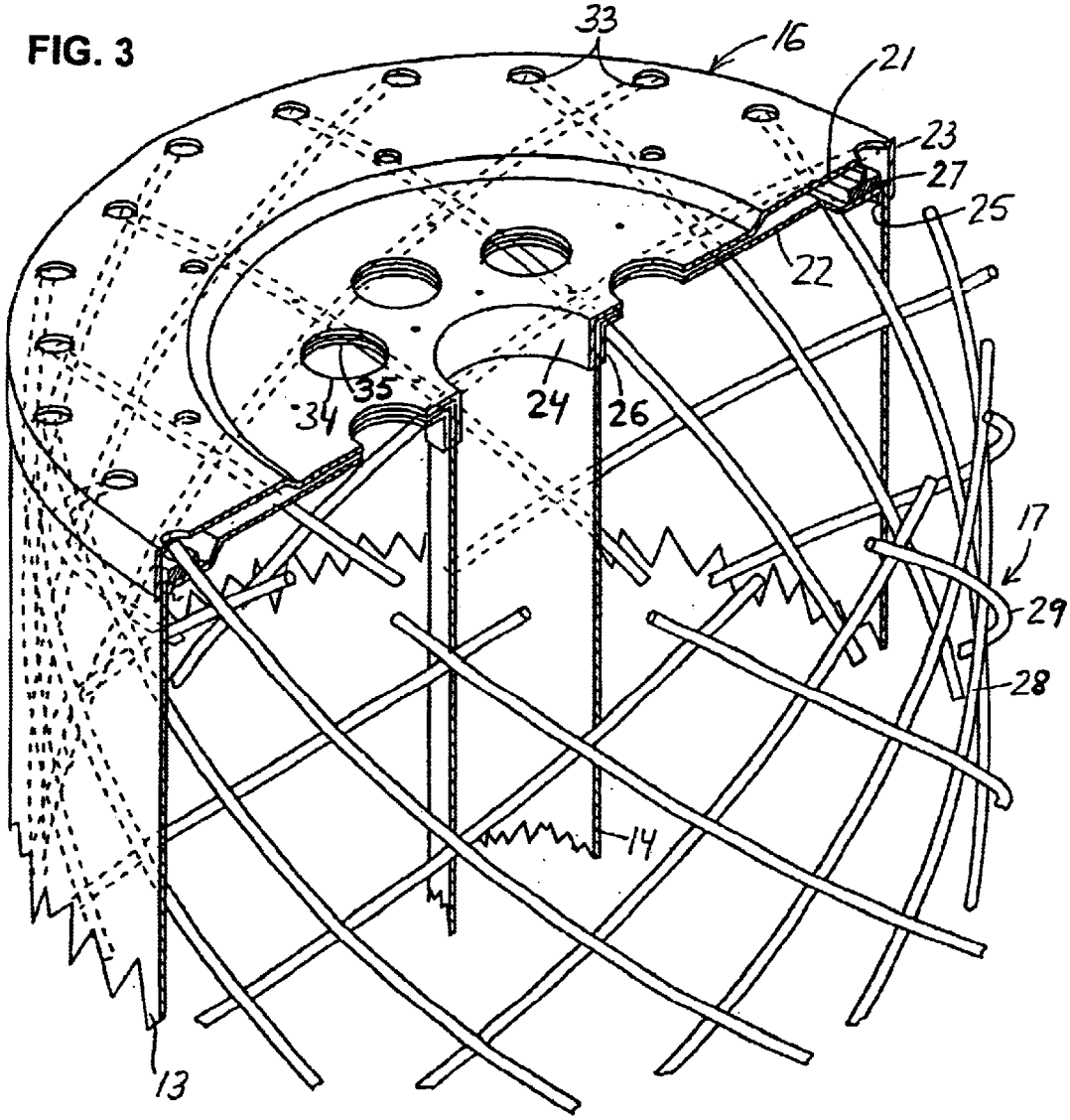
FIG. 3 is a perspective view of the end cover shown in FIG. 2, part of the reinforcement anchored to the end cover, and part of the formwork parts, the end cover and the formwork parts being shown in diametral section.
Figure 4:
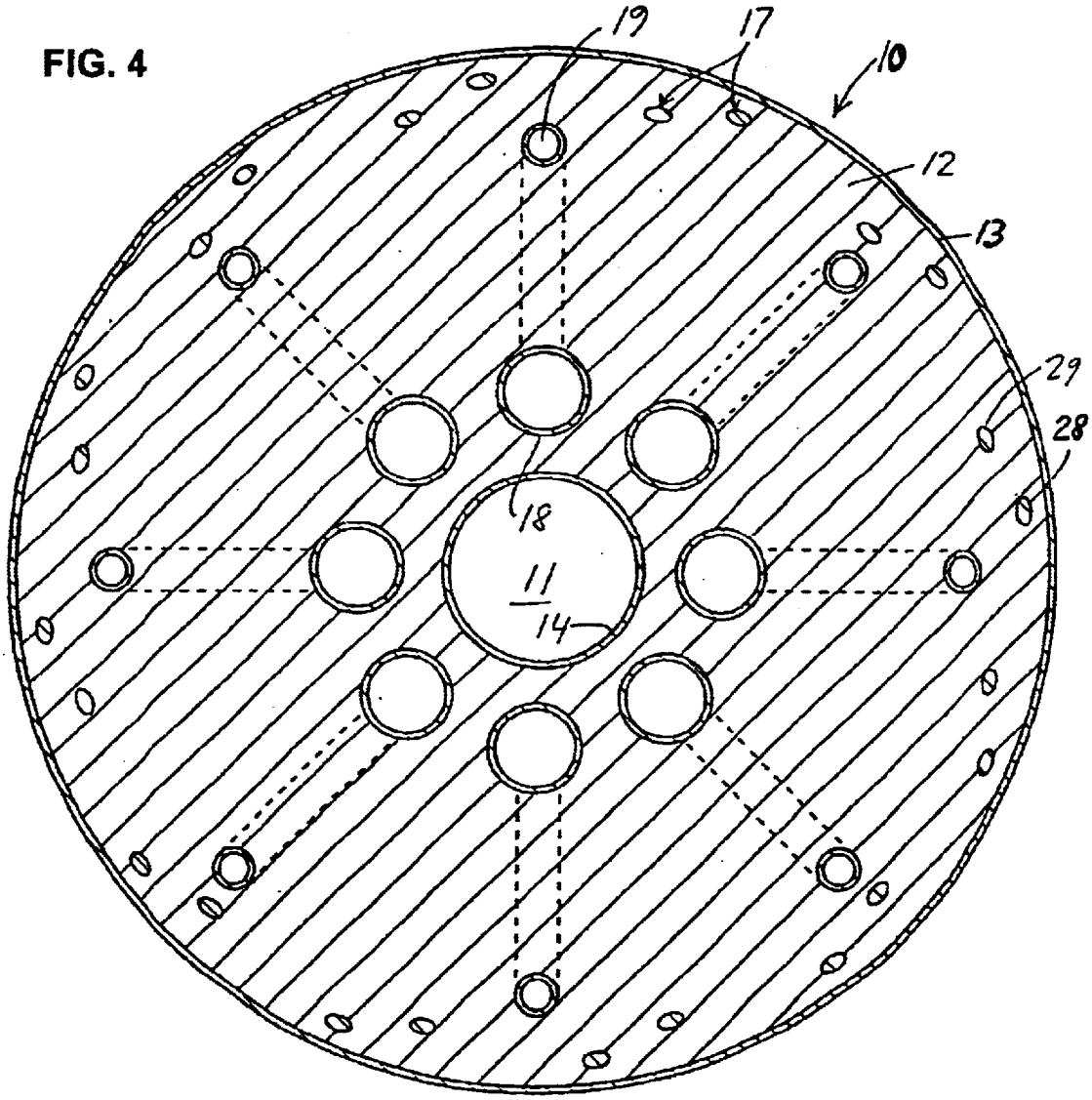
FIG. 4 is a horizontal sectional view of the storage device shown in FIG. 1.

The storage device shown in FIGS. 1 to 6, which is hereinafter also referred to as a cask and designated by 10, is intended to be used especially for the storage of hazardous material in the form of spent, but still active and heat-producing nuclear fuel elements while awaiting reprocessing or other actions, the storage time being, for example, from one or a few years up to many decades. The figures show the cask 10 in use, that is, in a sealed condition and holding the fuel elements (not shown). The fuel elements are here presumed to be combined into fuel units, such as fuel assemblies or bundles of fuel elements.

Broadly, the cask 10 is in the shape of a straight cylindrical body having an axial through cylindrical central passage 11 of circular cross-section. The main part of the space accommodated by the cask is occupied by a concrete body 12, which is also in the shape of a straight cylinder having a cylindrical central passage of circular cross-section.

The cylindrical outer surface of the concrete body 12 is covered by a cylindrical shell 13, and its central passage is lined with a cylindrical centre tube 14 forming the major part of the central passage 11. The shell 13 and the centre tube 14 are permanent parts of the formwork in which the concrete body 12 is cast, i.e. they remain parts of the cask 10 in use. As will appear from the following description, these parts are suitably made of a material of high thermal conductivity, such as steel.

The ends of the concrete body 12 are covered by a circular lower end cover 15 and a similar upper end cover 16. As will be seen from the following detailed description, the end covers 15 and 16 are made of sheet steel and like the shell 13 and the centre tube 14 they are permanent formwork parts.

Embedded in the concrete body 12 is a pre-stressed reinforcement, generally designated by 17, which is anchored in the end covers 15 and 16 and pre-stresses the concrete body three-dimensionally, that is axially and in all radial directions. The reinforcement 17, which will also be described in greater detail below, is positioned adjacent the cylindrical outer surface of the concrete body 12.

A number of closed circular cylindrical storage vessels, designated by 18, which are hermetically sealed and form distributed storage compartments (fuel compartments) accommodating the stored fuel units, are completely, i.e. jointlessly embedded in the concrete body 12. In the illustrated embodiment, the storage vessels 18 are eight in number and positioned with their axes on an imaginary cylindrical surface which is concentric with the concrete body 12 and the central passage 11. As is apparent from the figures, see especially FIGS. 1 and 4, the distance separating the storage vessels 18 from the centre tube 14 is much smaller than the distance separating the storage vessels 18 and the shell 13. The storage compartments formed by the storage vessels 18 are filled with a fluid coolant, such as water.

In each storage vessel 18 the coolant circulates through natural convection (thermosiphon circulation) in a closed coolant circuit including a tube 19, the ends of which communicate with the interior of the storage vessel 18 at the upper and lower ends of the vessel and which is positioned mainly in the radially outer part of the concrete body 12. Thus, the coolant carries part of the heat produced in the storage vessel 18 outwardly to that part of the concrete body, and from that part the heat can dissipate into the ambient air or water. Additional heat is carried away inwardly into the central passage 11 from which it can be dissipated convectively into the ambient medium by air or water flowing upwardly through the passage.

That part of the coolant circuit which is located outside the storage vessel 18 also includes an expansion vessel 20 adjacent the upper end of the storage vessel.

The end covers 15 and 16 are substantially identical, and in the following description they are primarily represented by the upper end cover 16. Both end covers 15, 16 serve as end walls of the formwork in which the concrete body 12 is cast, as anchoring members for the reinforcement 17 of the concrete body, and as protective members of the ends of the concrete body in the completed cask 10. Additionally, the upper end cover 16 can serve as a work platform during stressing of the reinforcement and any future removal of the contents of the storage vessels 18. Such removal includes working off the concrete directly above the storage vessels 18, so that the upper ends of the storage vessels can be reopened.

As is apparent from the drawing figures, the end cover 16 consists mainly of an upper or outer plate 21 and a lower or inner plate 22. In the finished cask 10 the plates 21, 22 are joined together in a suitable manner, e.g. by welding, and the space between them is partly or completely filled with concrete. Advantageously, the space between the plates may also accommodate equipment which is accessible from the exterior of the cask 10 and used e.g. for monitoring and signalling purposes, such as equipment for temperature and activity measurements, leakage detection and communication with monitoring stations.

Both plates 21, 22 are circular and have a central opening of approximately the same diameter as the centre tube 14. At their inner edge and their outer edge the plates are provided with downwardly directed circular cylindrical rims 23 and 24 on the outer plate 21, and 25 and 26 on the inner plate 22. The rims 23 and 24 on the outer plate 21 extend over the rims 25 and 26 on the inner plate. The upper end of the shell 13 extends into the gap between the rims 23 and 25, and in a corresponding manner the upper end of the centre tube 14 extends into the gap between the rims 24 and 26.

On the radially outer part of the inner plate 24 an annular steel rail 27 is supported which serves as an anchoring member for two groups of circumferentially uniformly spaced anchoring members (rods, cables or wires) 28, 29 of the reinforcement 17, and as a means for introducing the pre-stressing forces into the concrete body. Additionally, the rail 27 serves as an anchoring member for a plurality of circumferentially spaced devices (not shown) for attaching lifting devices used for lifting the entire cask 10.

Figure 5:
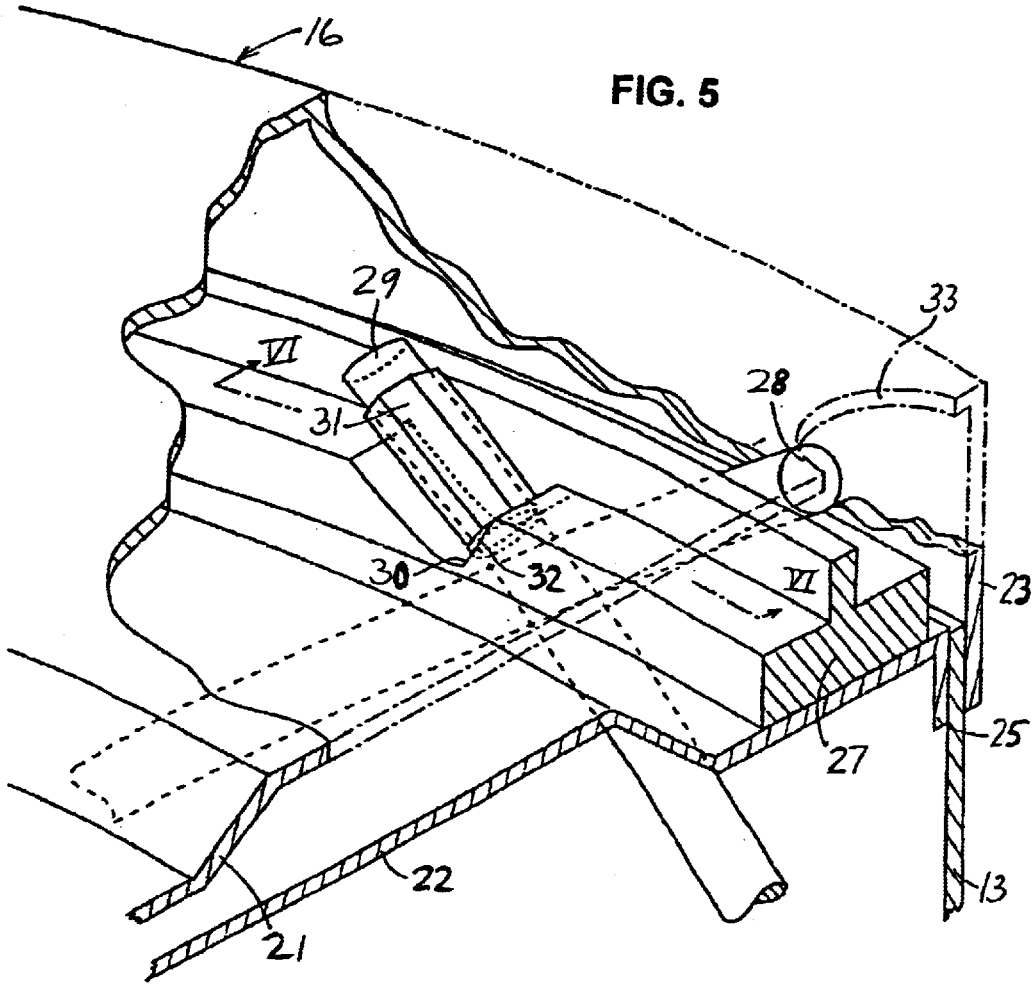
FIG. 5 is a perspective view, drawn to a larger scale and more detailed, of the part of the storage device shown in the upper right part of FIG. 1.
Figure 6:
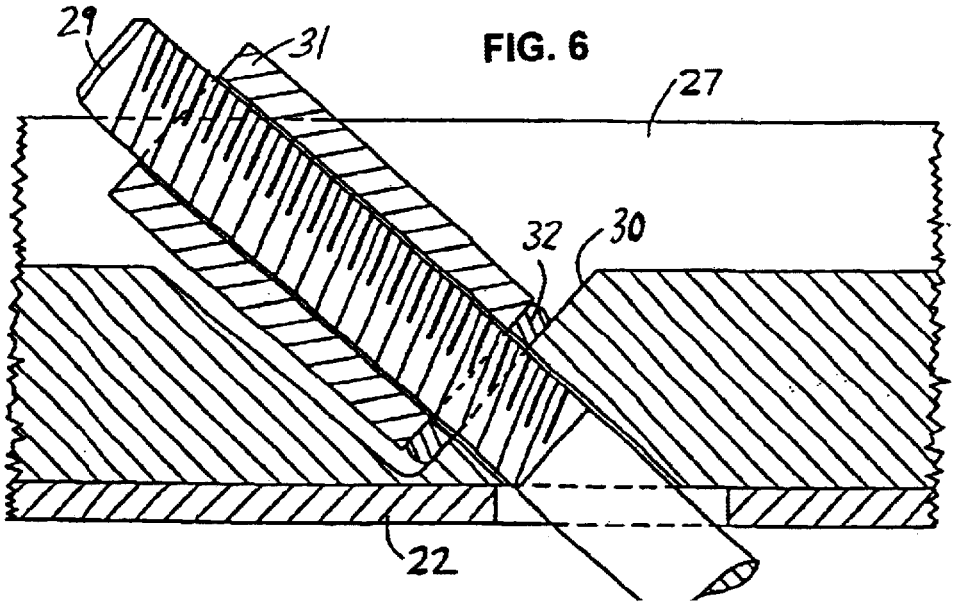
FIG. 6 is a sectional view of an anchoring device for a reinforcing member, the section being taken along a part of a cylindrical surface indicated by an arcuate line VI—VI in FIG. 5.

For each reinforcing member 28, 29 the rail 27 is provided with a seat 30 for an anchoring device which is shown in FIGS. 5 and 6, where it is exemplified by a nut 31 and an associated washer 32. These anchoring devices 31, 32 are accessible for manipulation through a ring of openings 33 in the outer plate 21.

The central portion of the outer plate 21 is depressed and provided with a number of openings 34, one such opening being directly above each storage vessel 18. In the inner plate 22 a corresponding opening 35 is provided. These openings are sized such that the fuel units can readily be introduced into the open upper ends of the storage vessels 18 before the concrete body 12 is formed by placement of the concrete. Preferably, the diameter of the openings 34, 35 is at least as large as the diameter of the storage vessels 18.

Adjacent the openings 34 the upper plate 21 also is provided with auxiliary means, symbolically represented by dots 36 in FIG. 1, for the positioning and attachment of suitable tools for working off the concrete beneath the openings when the contents of the storage vessels 18 are to be made accessible a shorter or longer storage time after the cask 10 has been completed, such as when the stored fuel units are to be extracted to be subjected to inspection or reprocessing or other treatment.

In the upper end cover 16 a ring of openings 37 are formed for the passage of concrete placing tubes, so-called tremie tubes, (these tubes are not shown) through which concrete is introduced into the space defined between the shell 13, the centre tube 14 and the end covers 15, 16.

The lower end cover 15 may be substantially identical with the upper end cover 16 but may also be modified at least such that it does not have openings corresponding to the openings 34, 35 and 37 of the upper end cover.

FIGS. 2 to 6 show the steel reinforcement 17 in greater detail. A characteristic feature of the reinforcement 17 is the disposition of each of the reinforcing members 28, 29 of the two groups along a spiral line, namely a cylindrical helical line, between the end covers 15 and 16. In one of the two groups the reinforcing members 28 are disposed along an imaginary cylindrical surface slightly closer to the shell 13 than the reinforcing members 29 of the other group, which are also disposed along an imaginary cylindrical surface and the hand of which is opposite to the hand of the reinforcing members of the first group. The two imaginary cylindrical surfaces are concentric with the shell 13 and the centre tube 14. Suitably, the helix angle of all reinforcing members is about 45°, and at least at some of their intersections the reinforcing members suitably are interconnected by wire bindings or other suitable interconnecting members (not shown).

For reasons which will become apparent, each reinforcing member 28, 29 suitably is enclosed in a tubular sheath (not shown in the drawings).

Production of the illustrated cask 10 can take place in various ways, depending on the detailed construction of the cask, the contemplated use of the cask, the available production facilities etc. The following brief description of a production procedure is to be regarded as an illustrative example of production that takes place in more or less direct connection with the charging of the storage vessels 18 with the fuel units. However, the main steps of the described production procedure may be regarded as applicable and suitable in most cases. The sequential order of some of the various steps may also vary.

Initially, the lower end cover 15 is placed on a support. This end cover is substantially completed, i.e. the space defined between the plates is already filled with hardened concrete, so that the end cover can take the load applied by the later placed wet concrete that will form the concrete body 12. Alternatively, the lower end cover 15 may be without the concrete filling, but in that case it must be provided with suitable supports between the plates so that the pressure applied by the overlying concrete will not deform the end cover.

Then the storage vessels 18 with their coolant tubes 19 are mounted. Suitably, they are combined to form a unit that can be brought into the desired position and kept in that position by means of suitable auxiliary devices. Moreover, the shell 13 and the centre tube 14 are mounted on and secured to the lower end cover 15.

The reinforcement 17 may be mounted before or after the positioning of the shell 13 on the lower end cover 15. If desired, the reinforcing members 28, 29 and their sheaths, if sheaths are used, may be combined into a unit (reinforcement cage) which can be lifted into position and secured to the lower end cover 15. If desired, this unit may also be secured to the upper end cover 16 prior to the lifting and securing operation, or the upper end cover may be secured to the upper end cover 16 after the reinforcement 17 has been brought into position.

When the parts making up the formwork for the concrete body 12 have been assembled and the unit formed by the storage vessels 18 has been mounted, the storage vessels are filled with a liquid coolant (such as water) to a predetermined level. At this time the upper ends of the storage vessels 18 are still open. Then the fuel units are introduced into the storage vessels 18 which are provided with suitable interior elements keeping the fuel units in a predetermined position. After that the storage vessels are hermetically closed by a cover or other suitable closure, if desired after the liquid coolant has been replaced with a different, liquid or gaseous coolant. The just-mentioned operations are carried out through the openings 34, 35 in the upper end cover 16.

Then the concrete is placed through a plurality of placing tubes (not shown) which are passed through the openings 37 and lowered until they open in the vicinity of the lower end cover 15. Concrete is fed through the placing tubes, and as the level of the wet concrete raises, the placing tubes are also raised so that they always open just below the concrete surface.

If the upper end cover 16 has not previously been filled with concrete, or has been filled incompletely, concrete is placed in the space between the outer plate 21 and the inner plate 22. This is suitably done after the placing of the concrete in the space defined by the shell 13, the centre tube 14 and the end covers 15, 16, e.g. when the concrete placed in that space has been allowed to set and harden for about 24 hours. However, the space at the outer part of the end covers, i.e. the space where the rail 27 is positioned, is left unfilled for some additional time, because the anchoring devices 31, 32 still have to be accessible for manipulation so that the reinforcing members can be pre-stressed and firmly anchored in the pre-stressed condition.

The introduction of the fuel units into the storage vessels 18 and the placement of the concrete to form the concrete body 12 may advantageously be carried out with the space defined by the shell 13, the centre tube 14 and the end covers 15, 16 filled with water, completely or up to a suitable level. This ensures an efficient and constant cooling of the fuel units.

After the concrete body 12 has been allowed to set and harden for a suitable time, e.g. for 2 to 4 days, the reinforcing members 28, 29 are tensioned. This is suitably done by means of jacks which are connected to the reinforcing members in a conventional manner through the openings 33 in the outer plate 21 and corresponding openings in the lower end cover 15. The containment of the reinforcing members in tubular sheaths, which may be filled with a lubricant, if desired, ensures that the tension force is carried all the way between the end covers 15, 16. Any necessary aftertensioning of the reinforcement 17 can be carried out after some additional time. When the tensioning is completed, concrete may be injected into the tubular sheaths. Then the space accommodating the rail 27 and the anchoring devices 31, 32 may be filled with concrete, and an annular cover plate may be placed in the depressed central part of the upper end cover 16.

As soon as the concrete has hardened sufficiently to admit of transport of the cask 10, the cask is moved to and placed in a storage site in open air, under a roof, or in water. A plurality of similar casks 10 can be stacked so that the central passages 11 form a shaft in which the air or water flows upwardly by natural convection (chimney draught) caused by heat conducted from the storage vessels 11 through the concrete and the centre tube 14, and/or under the action of fans or pumps. Heat conducted radially outwardly from the storage vessels to the outer side of the cask 10 by the coolant circulating through the storage vessels 18 is carried away by air or water contacting the shell 13.

When the cask 10 is completed, the depressed portion of the upper end cover 16 may be provided with an annular cover plate of steel.

Figure 7:
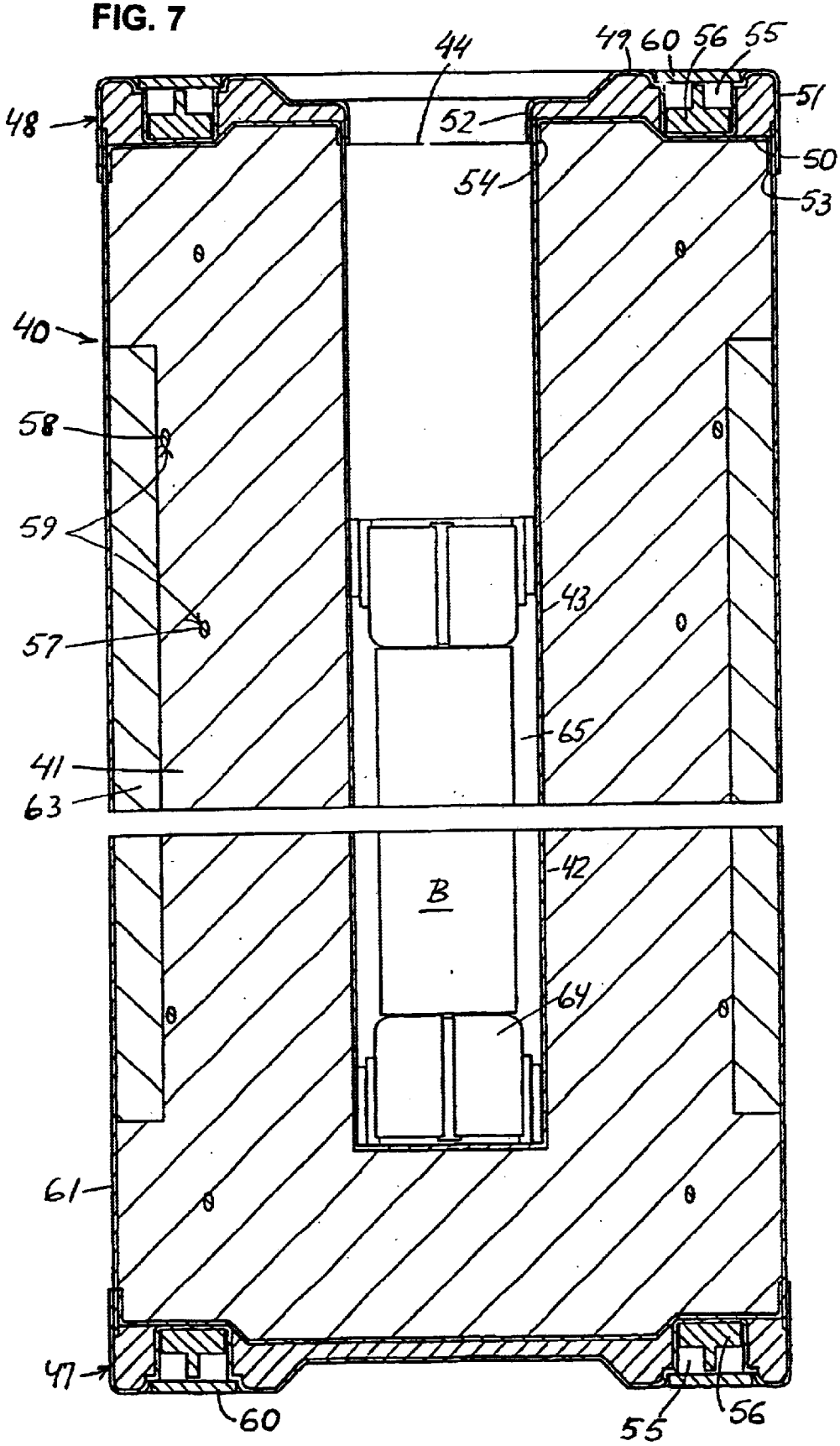
FIG. 7 is a view in axial section of a modified embodiment of the storage device according to the invention.

The storage device 40 shown in FIG. 7, which is hereinafter also designated as a cask, is primarily intended for interim or other relatively short-term storage of hazardous material, especially during transport of nuclear fuel units, e.g. when moving nuclear fuel units from interim storage pools to a long-term storage site.

The cask 40 differs from the cask 10 of FIGS. 1–6 in that its concrete body 41 is provided with a central cavity 42 that does not extend all the way through it, but only from the upper end of the concrete body down to a level which is spaced above the lower end of the concrete body. The cavity 42 is lined with an open-topped storage vessel 43 forming a storage compartment for a nuclear fuel unit B.

Another difference is that the cask 40 has no separate cooling arrangement. Because the storage is of a short-term nature the heat produced by the fuel unit can be absorbed by the concrete body without undue heating of the cask. However, if the cask 40 should require separate cooling means, it may be provided with a number of through axial passages which are disposed in a ring about the storage vessel 43 and extend axially through the cask. Air or water can flow upwardly through the passages by natural convection to carry away heat conducted outwardly from the storage vessel 43.

A closure device 44, not shown in detail, for non-permanent sealing of the storage vessel 43 is received in the upper part of the storage vessel. This closure device can be removed relatively easily, so that the fuel unit B can be removed from the cask 10.

A further difference between the cask 10 and the cask 40 is that the two end covers 47 and 48 are differently constructed.

As in the preceding embodiment, the two end covers 47, 48 are substantially identical, except in that the lower end cover 47 does not have a central opening.

The upper end cover 48 has an outer or upper plate 49 and an inner or lower plate 50. These plates have downwardly directed circular cylindrical rims 51, 52 on the upper plate and 53, 54 on the lower plate for the same purpose as in FIGS. 1 to 6. Rims corresponding to the rims 51, 52 are also provided on the plates of the lower end cover 47.

Adjacent its outer edge each end cover 47, 48 has an annular depression 55 at which the upper plate 49 engages the inner plate 50. In the annular, outwardly open groove formed by the depression 55, an annular steel rail 56 is disposed, which, like the rail 27 in the preceding embodiment, serves as an anchoring member for a pre-tensioned reinforcement 59 formed from two groups of reinforcing members 57, 58 and functioning in the same manner as the reinforcement 17 in FIGS. 1 to 6. The groove is covered by an annular cover plate 60 and may be filled with concrete after the reinforcing members have been tensioned. Similarly, the depression in the central portion of the upper end cover 48 may be covered by a cover plate (not shown) which is mounted after the storage vessel 43 has been sealed.

Figure 8:
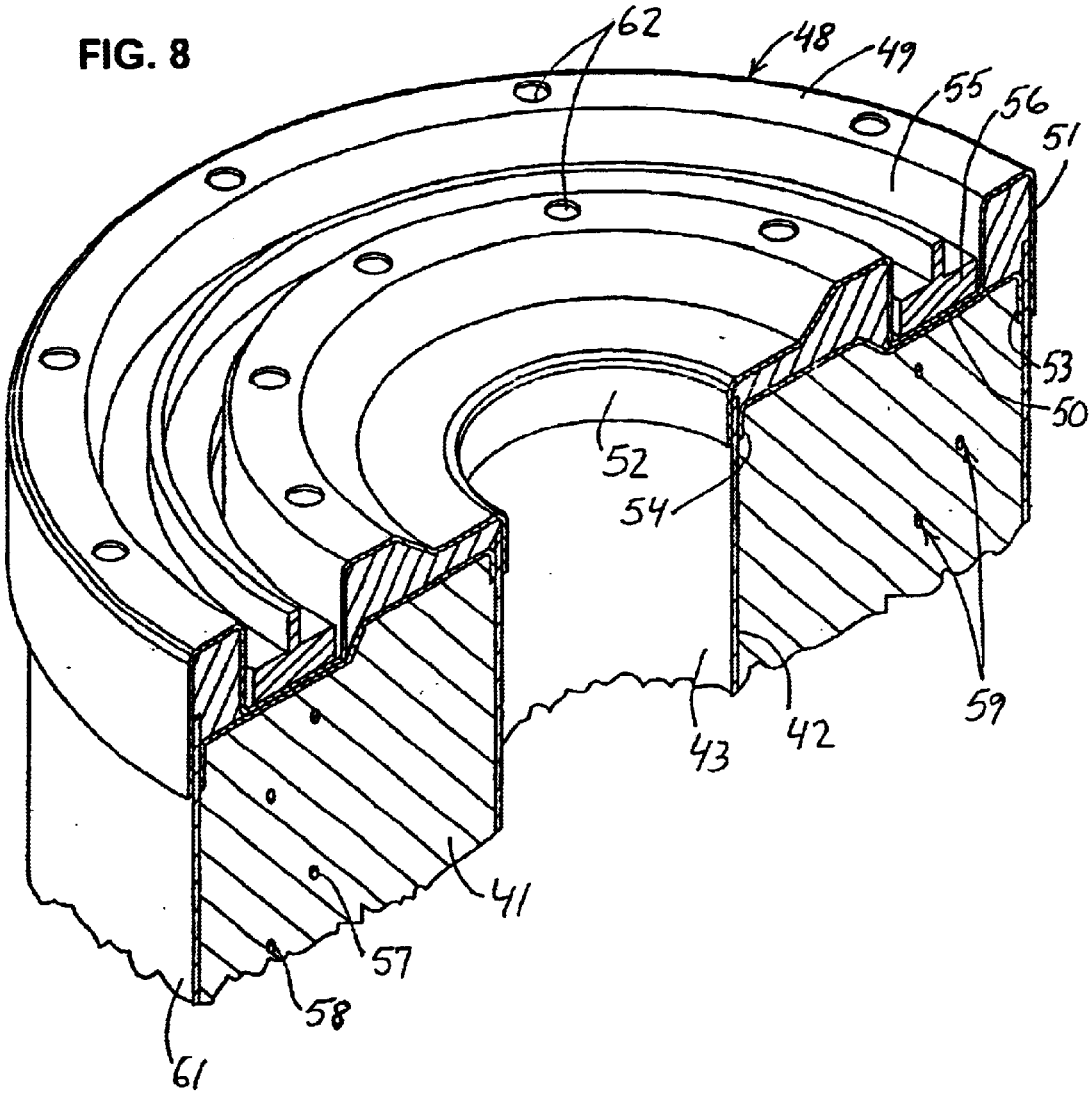
FIG. 8 is a sectional perspective view of the upper portion of the storage device shown in FIG. 7.

For the placement of concrete in the space defined by the shell 61, the storage vessel 43 and the two end covers 48, 49, a number of openings 62 (FIG. 8) are provided in the upper end cover 48. These openings may also be used for the placement of concrete in the open spaces between the outer and the inner end cover plates after the placement of the concrete forming the concrete body 41.

An additional difference is that the outer side of the concrete body 41 is provided with a metal jacket 63 which extends over and past, upwardly and downwardly, the section of the storage vessel 43 that accommodates the nuclear fuel unit B. This jacket, which is suitably made of steel, has a considerable wall thickness, e.g. 10 cm. It adds to the radiation protection afforded by the section of the concrete body 41 it encloses. The diameter of the concrete body can therefore be substantially smaller than in the case where the concrete body alone provides the radiation protection.

In the storage vessel 43 the fuel unit B rests on a pedestal 64 supported by the bottom wall of the storage vessel, and it is held in a centered position in the storage vessel by a number of circumferentially spaced ribs 65 mounted on the inside of the storage vessel 43.

What is claimed is:

1. A device for storage of hazardous material, especially heat-producing hazardous material such as radioactive spent nuclear fuel, comprising a substantially cylindrical concrete body which includes a three-dimensional prestressed reinforcement and which has an axially elongate storage space for the hazardous material, wherein the prestressed reinforcement includes reinforcing members which extend helically about the storage space and which are provided and embedded in the concrete body adjacent to the outer side thereof; and wherein the reinforcing members are divided into two groups, one inside and close to the other, a hand of the helical reinforcing members of one of the groups being opposite to a hand of the helical reinforcing members of the other group.

2. A device according to claim 1, characterised in that the ends of the concrete body are provided with end covers and in that the reinforcing members are anchored in the end covers.

3. A device according to claim 2, characterised in that each end cover includes an inner plate engaging the concrete body and an outer plate, which is spaced from the inner plate over at least the major part of the end cover, the space between the plates being at least partly filled with concrete.

4. A device according to claim 3, characterised in that each end cover includes a rail extending along the outer edge of the end cover, and in that the reinforcing members are secured to the rail.

5. A device according to claim 4, characterised in that the rail is disposed in a depression formed in the end cover.

6. A device according to claim 5, characterised in that the depression is formed in the outer plate and in that the bottom wall of the depression engages the inner plate.

* * * * *